US006517022B1

(12) United States Patent
Bailey

(10) Patent No.: US 6,517,022 B1
(45) Date of Patent: Feb. 11, 2003

(54) CABLE STORAGE DEVICE

(76) Inventor: Richard A. Bailey, 49 Bath St., #3, Ballston Spa, NY (US) 12020

( * ) Notice: Subject to any disclaimer, the term of this patent is extended or adjusted under 35 U.S.C. 154(b) by 0 days.

(21) Appl. No.: 09/871,786

(22) Filed: Jun. 1, 2001

(51) Int. Cl.[7] ..... B65H 75/30; B65H 75/40

(52) U.S. Cl. ..... 242/388.1; 242/395; 242/405; 242/405.1

(58) Field of Search ..... 242/395, 395.1, 242/388, 388.1, 388.3, 388.4, 388.5, 388.6, 405, 405.1, 405.2, 405.3, 406

(56) References Cited

U.S. PATENT DOCUMENTS 874,130 A * 12/1907 Stanley ..... 242/395.1
1,679,178 A * 7/1928 Shillman ..... 242/395.1
1,844,673 A * 2/1932 Nicewonger ..... 242/405
3,473,754 A * 10/1969 Quenot ..... 242/405
4,106,719 A * 8/1978 Haverland ..... 242/405.3
4,284,180 A * 8/1981 Masters ..... 242/388.6
4,661,660 A * 4/1987 von Sothen et al. ..... 242/388.1
D339,976 S 10/1993 Ferguson
5,332,171 A 7/1994 Steff
5,535,960 A 7/1996 Skowronski et al.
5,671,833 A 9/1997 Edwards et al.
5,732,898 A 3/1998 Odessky et al.
5,797,558 A * 8/1998 Peterson et al. ..... 242/378.2

* cited by examiner

*Primary Examiner*—John M. Jillions

(57) ABSTRACT

A cable storage device for providing a storage for cable. The cable storage device includes a housing assembly including a housing member; and also includes a handle member being attached to an exterior of the housing member; and further includes a spool member being rotatably disposed in the housing member and being adapted to carry a cable; and also includes a crank member being attached to the spool member for turning the spool member to take up the cable; and further includes bracket members being securely attached to the housing member and being adapted to support an end portion of the cable.

18 Claims, 3 Drawing Sheets

CABLE STORAGE DEVICE

BACKGROUND OF THE INVENTION

1. Field of the Invention

The present invention relates to cable storage spools and more particularly pertains to a new cable storage device for providing a storage for cable.

2. Description of the Prior Art

The use of cable storage spools is known in the prior art. More specifically, cable storage spools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,732,898; U.S. Pat. No. 5,671,833; U.S. Pat. No. 5,535,960; U.S. Pat. No. 4,284,180; U.S. Pat. No. 5,332,171; and U.S. Pat. No. Des. 339,976.

While these devices fulfill their respective, particular objectives and requirements, the aforementioned patents do not disclose a new cable storage device. The inventive device includes a housing assembly including a housing member; and also includes a handle member being attached to an exterior of the housing member; and further includes a spool member being rotatably disposed in the housing member and being adapted to carry a cable; and also includes a crank member being attached to the spool member for turning the spool member to take up the cable; and further includes bracket members being securely attached to the housing member and being adapted to support an end portion of the cable.

In these respects, the cable storage device according to the present invention substantially departs from the conventional concepts and designs of the prior art, and in so doing provides an apparatus primarily developed for the purpose of providing a storage for cable.

SUMMARY OF THE INVENTION

In view of the foregoing disadvantages inherent in the known types of cable storage spools now present in the prior art, the present invention provides a new cable storage device construction wherein the same can be utilized for providing a storage for cable.

The general purpose of the present invention, which will be described subsequently in greater detail, is to provide a new cable storage device which has many of the advantages of the cable storage spools mentioned heretofore and many novel features that result in a new cable storage device which is not anticipated, rendered obvious, suggested, or even implied by any of the prior art cable storage spools, either alone or in any combination thereof.

To attain this, the present invention generally comprises a housing assembly including a housing member; and also includes a handle member being attached to an exterior of the housing member; and further includes a spool member being rotatably disposed in the housing member and being adapted to carry a cable; and also includes a crank member being attached to the spool member for turning the spool member to take up the cable; and further includes bracket members being securely attached to the housing member and being adapted to support an end portion of the cable.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cable storage device which has many of the advantages of the cable storage spools mentioned heretofore and many novel features that result in a new cable storage device which is not anticipated, rendered obvious, suggested, or even implied by any of the prior art cable storage spools, either alone or in any combination thereof.

It is another object of the present invention to provide a new cable storage device which may be easily and efficiently manufactured and marketed.

It is a further object of the present invention to provide a new cable storage device which is of a durable and reliable construction.

An even further object of the present invention is to provide a new cable storage device which is susceptible of a low cost of manufacture with regard to both materials and labor, and which accordingly is then susceptible of low prices of sale to the consuming public, thereby making such cable storage device economically available to the buying public.

Still yet another object of the present invention is to provide a new cable storage device which provides in the apparatuses and methods of the prior art some of the advantages thereof, while simultaneously overcoming some of the disadvantages normally associated therewith.

Still another object of the present invention is to provide a new cable storage device for providing a storage for cable.

Yet another object of the present invention is to provide a new cable storage device which includes a housing assembly including a housing member; and also includes a handle member being attached to an exterior of the housing member; and further includes a spool member being rotatably disposed in the housing member and being adapted to carry a cable; and also includes a crank member being attached to the spool member for turning the spool member to take up the cable; and further includes bracket members being securely attached to the housing member and being adapted to support an end portion of the cable.

Still yet another object of the present invention is to provide a new cable storage device that is easy and convenient to use.

Even still another object of the present invention is to provide a new cable storage device that allows the user to protect the cable and to quickly let out and take up the cable without it becoming tangled.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
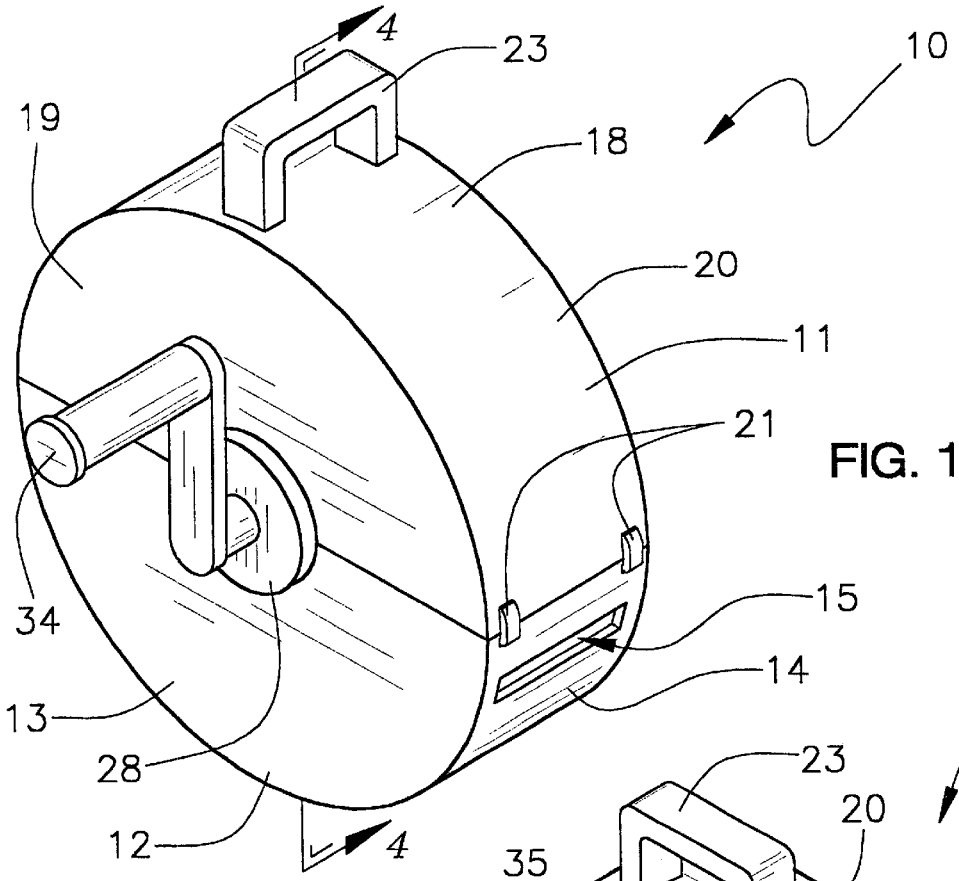
FIG. 1 is a perspective view of a new cable storage device according to the present invention.
Figure 2:
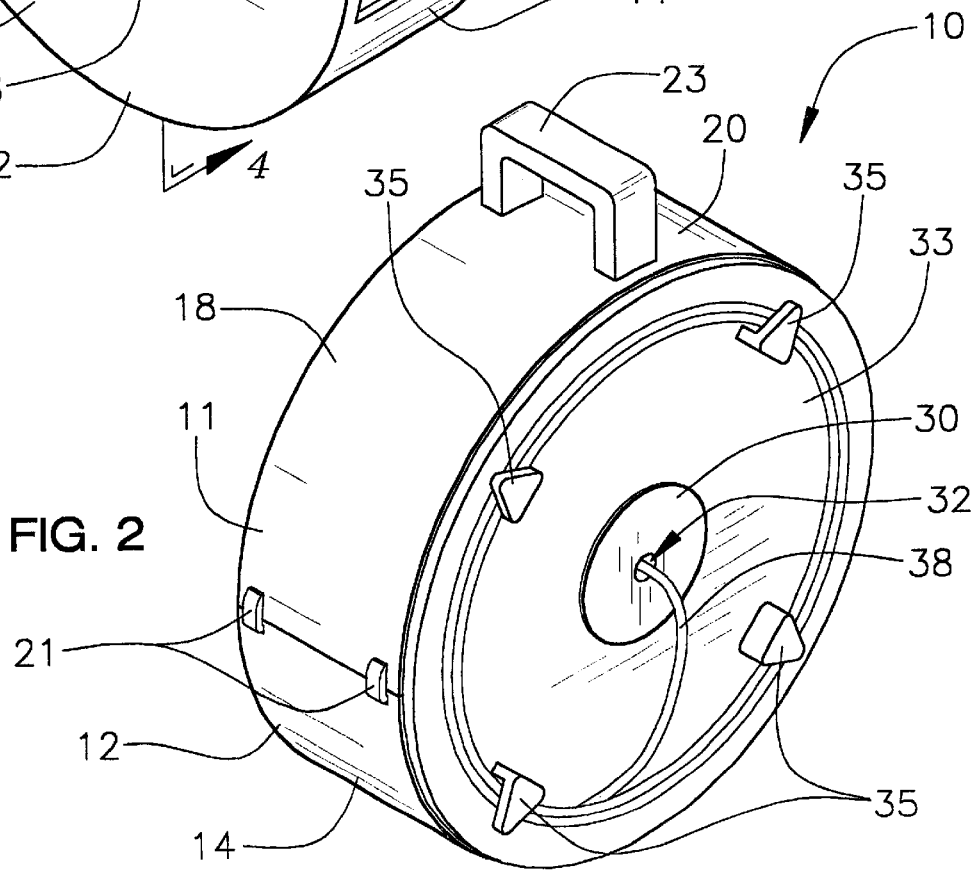
FIG. 2 is another perspective view of the present invention.
Figure 3:
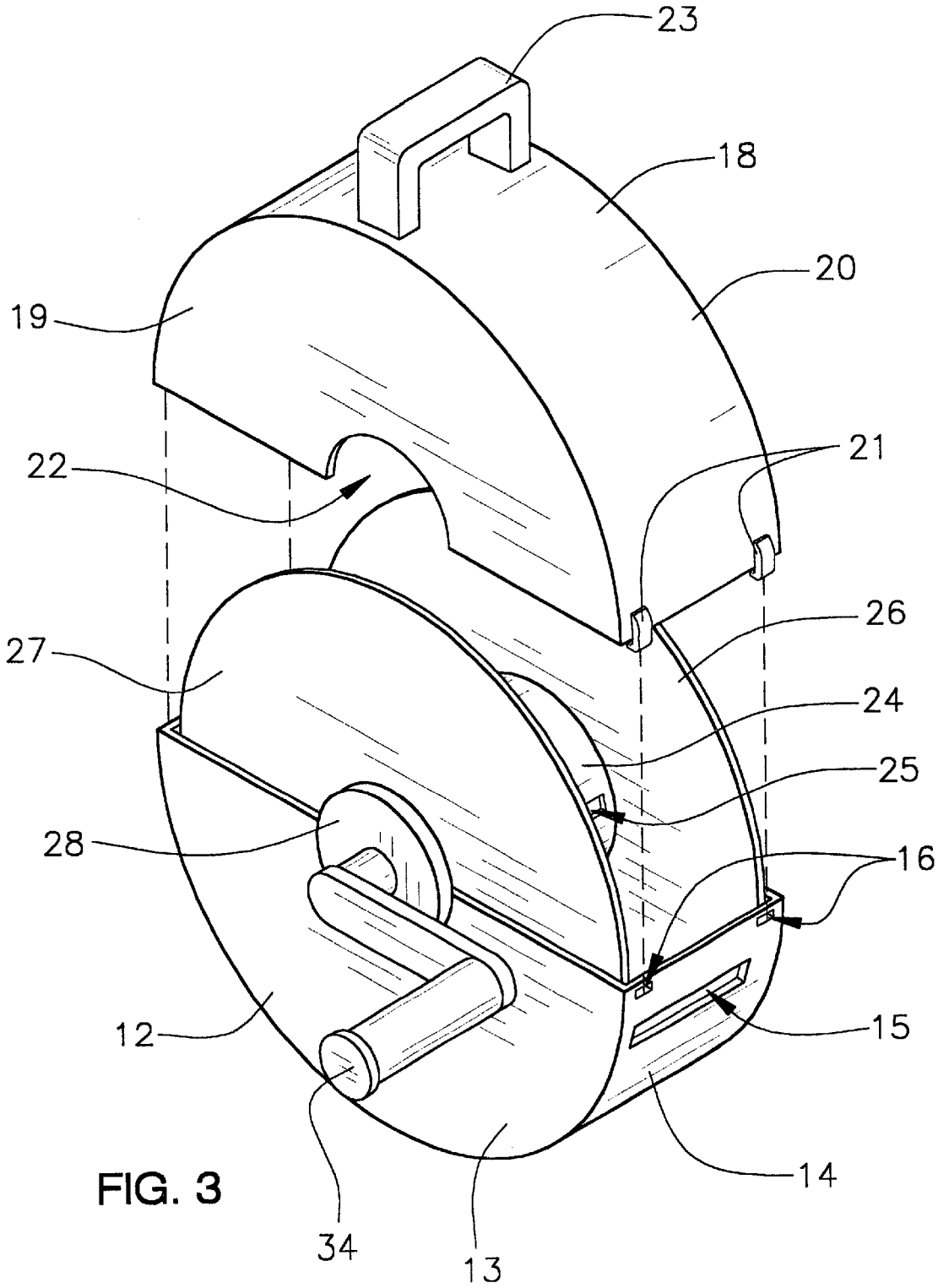
FIG. 3 is an exploded perspective view of the present invention.
Figure 4:
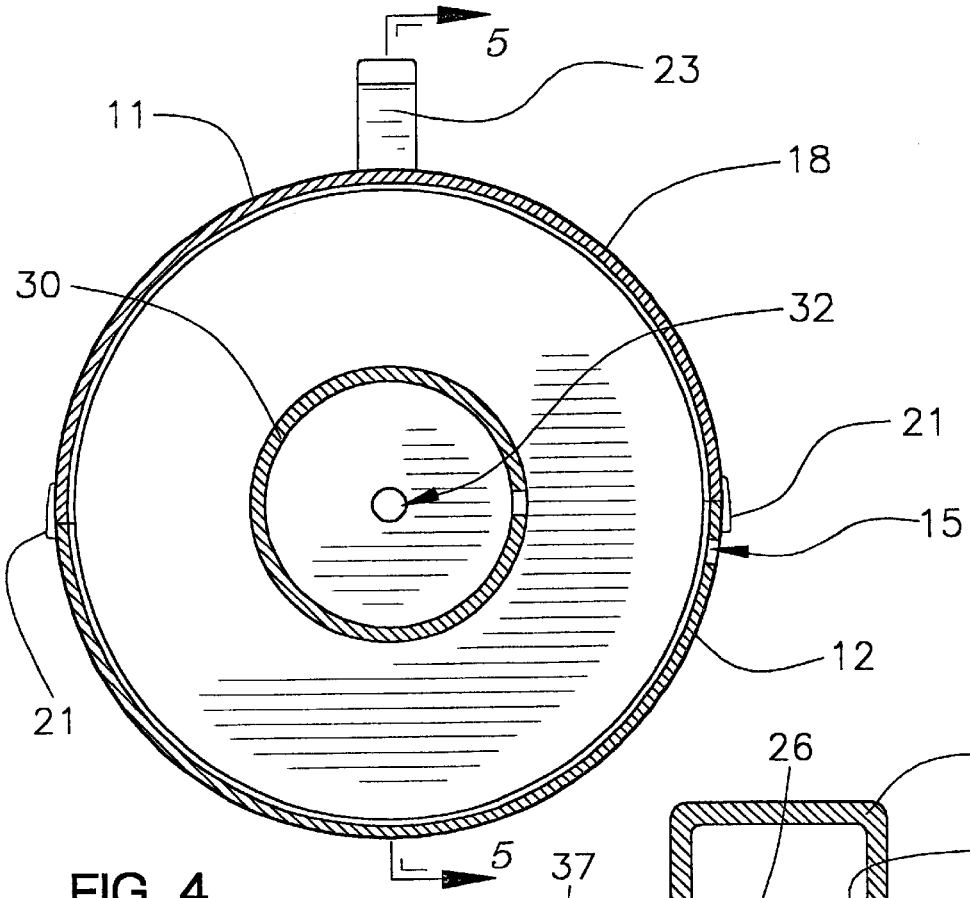
FIG. 4 is a longitudinal cross-sectional view of the present invention.
Figure 5:
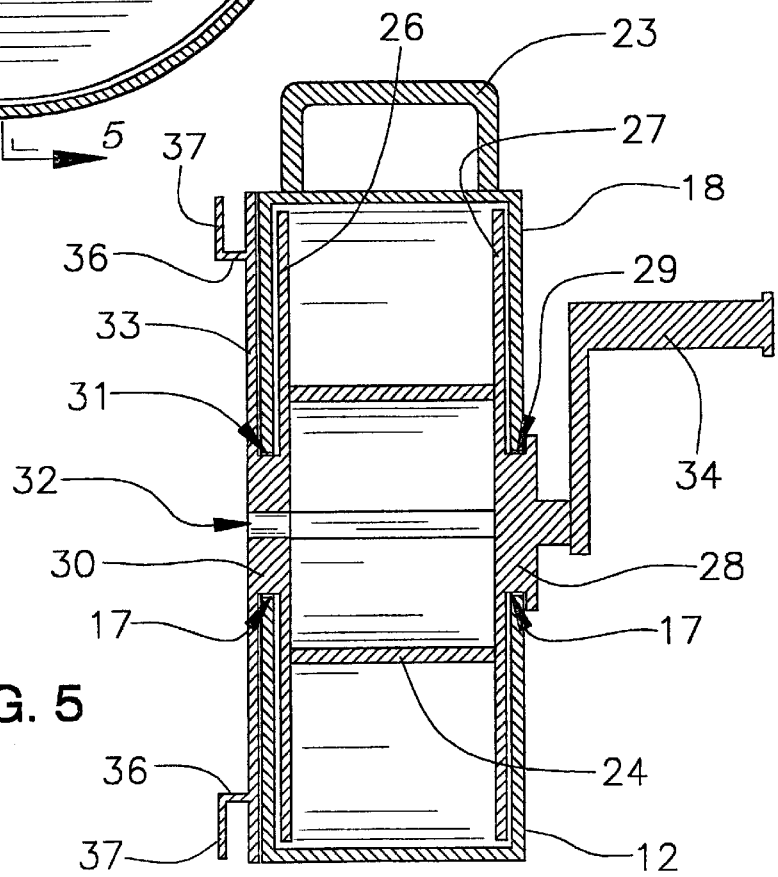
FIG. 5 is a lateral cross-sectional view of the present invention.

With reference now to the drawings, and in particular to FIGS. 1 through 5 thereof, a new cable storage device embodying the principles and concepts of the present invention and generally designated by the reference numeral 10 will be described.

As best illustrated in FIGS. 1 through 5, the cable storage device 10 generally comprises a housing assembly including a housing member 11. The housing member 11 is disc-shaped and is split into two halves one being a housing base 12 and the other being a housing cover 18. Each of the housing base 12 and the housing cover 18 includes side walls 13,19 and a curved circumferential wall 14,20, and also includes arcuate slots 17,22 being disposed in edges of the side walls 13,19. The base housing 12 further includes an elongate opening 15 being disposed through the curved circumferential wall 14 near an end edge thereof, and also includes holes 16 being also disposed through the curved circumferential wall 14 near end edges thereof with the elongate opening 15 being adapted to receive a cable 38 therethrough. The housing assembly further includes clip-like fastening members 21 being securely and conventionally attached at end edges of the curved circumferential wall 20 of the housing cover 18 and being removably received in the holes 16 of the housing base 12 for fastening the housing cover 18 to the housing base 12.

A handle member 23 is conventionally attached to an exterior of the housing member 11 with the handle member 23 being securely attached to an exterior of the curved circumferential wall 20 of the housing cover 18. A spool member is rotatably disposed in the housing member 11 and is adapted to carry the cable 38. The spool member includes a cylindrical cable support member 24 being rotatably disposed in the housing member 11, and also includes disc-shaped end walls 26,27 being conventionally attached at ends of the cylindrical cable support member 24, and further includes first and second boss members 28,30 being conventionally attached to the disc-shaped end walls 26,27 and each having a groove 29,31 being disposed in a circumference thereof and removably receiving curved edges of the arcuate slots 17,22 of the housing base 12 and the housing cover 18, and also includes a disc-shaped bracket support member 33 being conventionally attached to the second boss member 30 and being spacedly disposed upon one of the side walls 13,19 of the housing base 12 and the housing cover 18. The second boss member 30 has a bore 32 extending therethrough and being adapted to receive the end portion of the cable 38. The cylindrical cable support member 24 includes a longitudinal opening 25 being disposed therethrough and being adapted to receive a portion of the cable 38 for winding about the cylindrical cable support member 24. A crank member 34 is conventionally attached to the spool member for turning the spool member to take up the cable 38. The crank member 34 is conventionally attached to the first boss member 28. Bracket members 35 are securely and conventionally attached to the housing member 11 and are adapted to support an end portion of the cable 38. The bracket members 35 are securely attached along a perimeter of the disc-shaped bracket support member 33. Each of the bracket members 35 is L-shaped and has a first portion 36 being conventionally attached to the disc-shaped bracket support member 33 and also has a second portion 37 being angled relative to the first portion 36 and being spaced from the disc-shaped bracket support member 33.

In use, the user lets out the cable through the elongate opening 15 in the housing base 12, and uses the crank member 34 to wind the cable 38 about the cylindrical cable support member 24 when not using the cable.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cable storage device comprising:

a housing assembly including a housing member;

wherein said housing member is disc-shaped and is split into two halves, said halves comprising a housing base and a housing cover;

wherein each of said housing base and said housing cover includes side walls and a curved circumferential wall, and also includes arcuate slots disposed in edges of said side walls;

a handle member being attached to an exterior of said housing member;

a spool member being rotatably disposed in said housing member and being adapted to carry a cable;

a crank member being attached to said spool member for turning said spool member to take up the cable;

bracket members being securely attached to said housing member and being adapted to support an end portion of the cable;

a disc-shaped bracket support member being attached to an end of said spool member and being spacedly disposed upon one of said side walls of said housing base and said housing cover; and wherein said bracket support member rotates with said spool member independently of said housing to facilitate taking up the end portion of the cable in a circumferential manner about each of said bracket members.

2. A cable storage device as described in claim 1, wherein said base housing further includes an elongate opening being disposed through said curved circumferential wall near an end edge thereof, and also includes holes being also disposed through said curved circumferential wall near end edges thereof, said elongate opening being adapted to receive the cable therethrough.

3. A cable storage device as described in claim 2, wherein said housing assembly further includes clip-like fastening members being securely attached at end edges of said curved circumferential wall of said housing cover and being removably received in said holes of said housing base for fastening said housing cover to said housing base.

4. A cable storage device as described in claim 1, wherein said handle member is securely attached to an exterior of said curved circumferential wall of said housing cover.

5. A cable storage device as described in claim 1, wherein said spool member includes a cylindrical cable support member being rotatably disposed in said housing member, and also includes disc-shaped end walls being attached at ends of said cylindrical cable support member; and first and second boss members being attached to said disc-shaped end walls and each having a groove being disposed in a circumference thereof for removably receiving curved edges of said arcuate slots of said housing base and said housing cover.

6. A cable storage device as described in claim 5, wherein said second boss member has a bore extending therethrough and being adapted to receive the end portion of the cable.

7. A cable storage device as described in claim 5, wherein said cylindrical cable support member includes a longitudinal opening being disposed therethrough and being adapted to receive a portion of the cable for winding about said cylindrical cable support member.

8. A cable storage device as described in claim 5, wherein said crank member is attached to said first boss member.

9. A cable storage device as described in claim 1, wherein said bracket members are securely attached along a perimeter of said disc-shaped bracket support member, each of said bracket members being L-shaped and having a first portion being attached to said disc-shaped bracket support member and also having a second portion being angled relative to said first portion and being spaced from said disc-shaped bracket support member.

10. A cable storage device comprising:

a housing assembly including a housing member;

a handle member being attached to an exterior of said housing member;

a spool member being rotatably disposed in said housing member and being adapted to carry a cable;

a crank member being attached to said spool member for turning said spool member to take up the cable;

bracket members being securely attached to said housing member and being adapted to support an end portion of the cable;

wherein said housing member is disc-shaped and is split into two halves one being a housing base and the other being a housing cover;

wherein each of said housing base and said housing cover includes side walls and a curved circumferential wall, and also includes arcuate slots disposed in edges of said side walls;

wherein said spool member includes a cylindrical cable support member being rotatably disposed in said housing member, and also includes disc-shaped end walls being attached at ends of said cylindrical cable support member;

first and second boss members being attached to said disc-shaped end walls and each having a groove being disposed in a circumference thereof for removably receiving curved edges of said arcuate slots of said housing base and said housing cover; and a disc-shaped bracket support member being attached to said second boss member and being spacedly disposed upon one of said side walls of said housing base and said housing cover.

11. A cable storage device as described in claim 10, wherein said base housing further includes an elongate opening being disposed through said curved circumferential wall near an end edge thereof, and also includes holes being also disposed through said curved circumferential wall near end edges thereof, said elongate opening being adapted to receive the cable therethrough.

12. A cable storage device as described in claim 11, wherein said housing assembly further includes clip-like fastening members being securely attached at end edges of said curved circumferential wall of said housing cover and being removably received in said holes of said housing base for fastening said housing cover to said housing base.

13. A cable storage device as described in claim 10, wherein said handle member is securely attached to an exterior of said curved circumferential wall of said housing cover.

14. A cable storage device as described in claim 10, wherein said second boss member has a bore extending therethrough and being adapted to receive the end portion of the cable.

15. A cable storage device as described in claim 10, wherein said cylindrical cable support member includes a longitudinal opening being disposed therethrough and being adapted to receive a portion of the cable for winding about said cylindrical cable support member.

16. A cable storage device as described in claim 10, wherein said crank member is attached to said first boss member.

17. A cable storage device as described in claim 10, wherein said bracket members are securely attached along a perimeter of said disc-shaped bracket support member, each of said bracket members being L-shaped and having a first portion being attached to said disc-shaped bracket support member and also having a second portion being angled relative to said first portion and being spaced from said disc-shaped bracket support member.

18. A cable storage device comprising:

a housing assembly including a housing member, said housing member being disc-shaped and being split into two halves one being a housing base and the other being a housing cover, each of said housing base and said housing cover including side walls and a curved circumferential wall, and also including arcuate slots disposed in edges of said side walls, said base housing further including an elongate opening being disposed through said curved circumferential wall near an end edge thereof, and also including holes being also disposed through said curved circumferential wall near end edges thereof, said elongate opening being adapted to receive the cable therethrough, said housing assembly further including clip-like fastening members being securely attached at end edges of said curved circumferential wall of said housing cover and being removably received in said holes of said housing base for fastening said housing cover to said housing base;

a handle member being attached to an exterior of said housing member, said handle member being securely attached to an exterior of said curved circumferential wall of said housing cover;

a spool member being rotatably disposed in said housing member and being adapted to carry a cable, said spool member including a cylindrical cable support member being rotatably disposed in said housing member, and also including disc-shaped end walls being attached at ends of said cylindrical cable support member, and further including first and second boss members being attached to said disc-shaped end walls and each having a groove being disposed in a circumference thereof and removably receiving curved edges of said arcuate slots of said housing base and said housing cover, and also including a disc-shaped bracket support member being attached to said second boss member and being spacedly disposed upon one of said side walls of said housing base and said housing cover, said second boss member having a bore extending therethrough and being adapted to receive the end portion of the cable, said cylindrical cable support member including a longitudinal opening being disposed therethrough and being adapted to receive a portion of the cable for winding about said cylindrical cable support member;

a crank member being attached to said spool member for turning said spool member to take up the cable, said crank member being attached to said first boss member; and bracket members being securely attached to said housing member and being adapted to support an end portion of the cable, said bracket members being securely attached along a perimeter of said disc-shaped bracket support member, each of said bracket members being L-shaped and having a first portion being attached to said disc-shaped bracket support member and also having a second portion being angled relative to said first portion and being spaced from said disc-shaped bracket support member.

* * * * *